United States Patent [19]

Lyons et al.

[11] 4,333,539

[45] Jun. 8, 1982

[54] METHOD FOR EXTENDED STRAIGHT LINE DRILLING FROM A CURVED BOREHOLE

[76] Inventors: William C. Lyons, 1209 Calle Luna, Santa Fe, N. Mex. 87501; Albert O. White, 1327 Fox Hollow Rd., Schenectady, N.Y. 12309

[21] Appl. No.: 108,686

[22] Filed: Dec. 31, 1979

[51] Int. Cl.[3] ..... E21B 4/02; E21B 7/08

[52] U.S. Cl. ..... 175/61; 175/107

[58] Field of Search ..... 175/61, 62, 75, 100, 175/107

[56] References Cited

U.S. PATENT DOCUMENTS

| | | | |
|---|---|---|---|
| 2,271,005 | 1/1942 | Grebe | 175/61 |
| 2,336,338 | 12/1943 | Zublin | 175/75 |
| 2,344,277 | 3/1944 | Zublin | 175/75 |
| 2,500,267 | 3/1950 | Zublin | 175/75 |
| 2,669,428 | 2/1954 | Zublin | 175/75 |

OTHER PUBLICATIONS

"Horizontal Drilling" The Oil Weekley Oct. 1, 1945, pp. 35–39.

*Primary Examiner*—James A. Leppink

*Attorney, Agent, or Firm*—James E. Snead

[57] ABSTRACT

Method and apparatus by which a vertical borehole is curved to a new angle and extended through a production reservoir. A vertical borehole of a suitable diameter is extended downhole to the proximate depth of the production reservoir. A Zublin drill guide apparatus is employed to drill a curved section of the hole, thereby turning the borehole to a desired angle so that the lower marginal end of the borehole is directed laterally away from the vertical part of the borehole. A drill pipe string is positioned within the vertical part of the borehole. A flexible pipe is fitted to the downhole end of the drill pipe string, and a Zublin straight drill guide assembly is fitted to the end of the flexible pipe. A motor, such as an expansible gas turbine motor, for example, is connected to the end of the straight drill guide assembly. A suitable drill bit is connected to be rotated by the turbine motor. Compressible fluid is applied to the upper end of the string at the surface of the ground and drives the turbine motor, which in turn rotates the drill bit. A fluid reaction system associated with the turbine motor provides a turning moment in opposition to the rotating bit while concurrently forcing the bit forward to penetrate the formation.

4 Claims, 9 Drawing Figures

FIG. 5
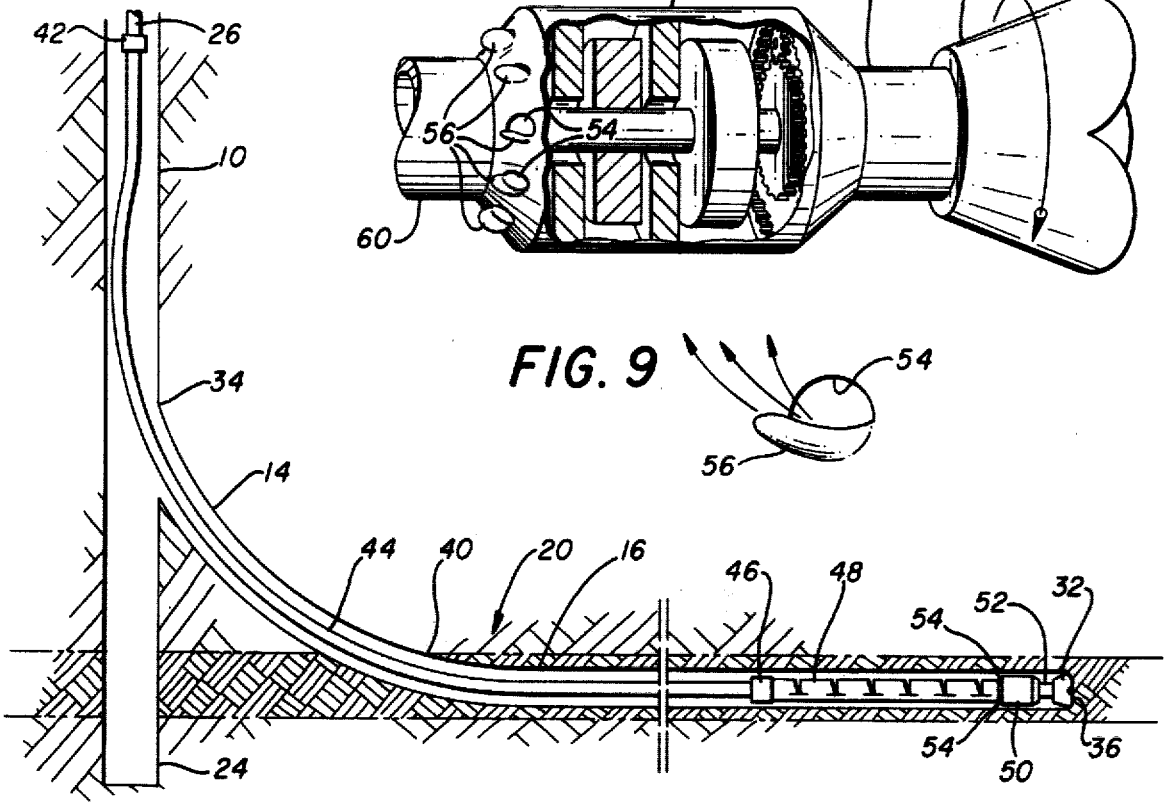
FIG. 8
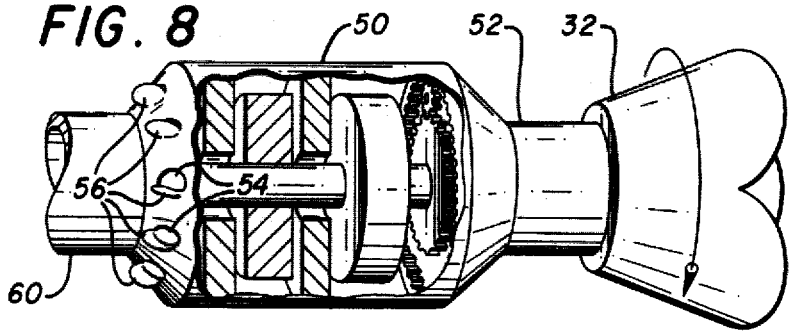
FIG. 9
FIG. 7
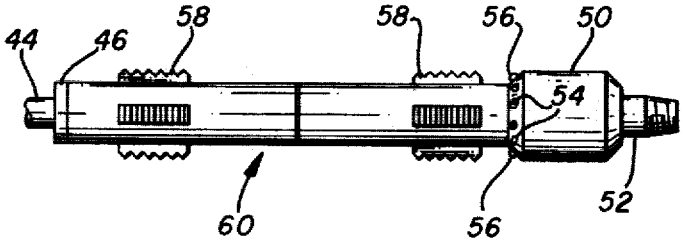
FIG. 6
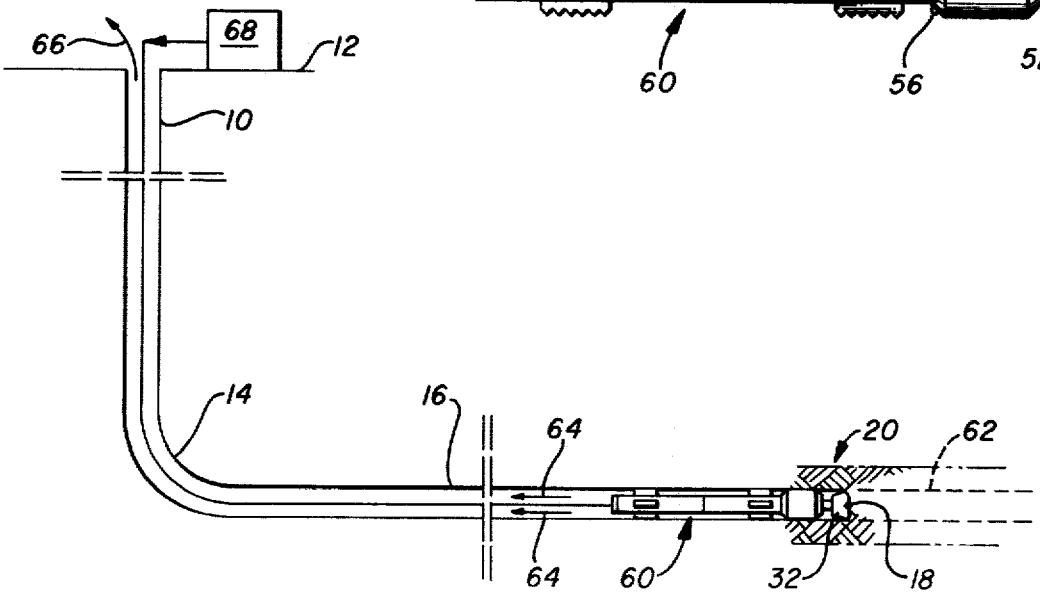

METHOD FOR EXTENDED STRAIGHT LINE DRILLING FROM A CURVED BOREHOLE

BACKGROUND OF THE INVENTION

There are many valuable deposits or sub-surface production reservoirs located 400–1000 feet below the surface of the earth which cannot be mined or produced economically by the employment of conventional mining or production techniques. In such an instance, it would be advantageous to be able to form a borehole which extends vertically downwardly and then turns laterally towards the horizontal such that the lateral portion of the borehole is extended a considerable distance through the ore body. The lateral portion of the borehole enables various different chemical treatments to be carried out, thereby enabling the mineral values to be extracted therefrom.

It is known to form a vertical borehole and to turn the borehole 90° such that the borehole extends a limited horizontal distance from the vertical borehole. The Zublin curved drilling method provides a reliable and highly accurate means by which straight drilling beyond the curve can be carried out for a limited distance. The following U.S. patents are considered of significance respective to the drilling of wellbores which are deviated from the vertical into the horizontal plane:

| U.S. Pat. No. | Date of Issuance | Title |
|---|---|---|
| 2,699,920 | Jan. 18, 1955 | Apparatus for drilling laterally deviating bores from a vertical bore below a casing set therein |
| 2,708,099 | May 10, 1955 | Flexible resilient normally curved tubular drill guide having friction shoes |
| 2,717,146 | Sept. 6, 1955 | Heavy duty flexible drill pipe |
| 2,734,720 | Feb. 14, 1956 | Apparatus for drilling wells with oriented curved bores of large radii |
| 2,734,082 | April 24, 1956 | Method of drilling deviating bores from existing wellbores |
| 2,745,634 | May 15, 1956 | Apparatus for drilling wells with oriented curved bores of large radii |
| 2,745,635 | May 15, 1956 | Apparatus for drilling wells of large radii curved bores |
| 2,804,926 | Sept. 3, 1957 | Perforated drain hole liner |

However, none of the above cited prior art references disclose the concept of drilling a vertical hole into proximity of a pay zone or production reservoir, turning the lower end of the hole to a desired angle with the curve having a small radius of curvature, and thereafter, continuing the borehole in a straight line laterally away from the vertical part of the borehole for an extended distance while penetrating the pay zone.

One of the problems frequently encountered in utilizing the Zublin drilling technique is that the lateral distance that can be drilled after deviation from the vertical is very limited because of the problems encountered in turning the drill bit under pressure. There are in existence in the prior art some devices which aid in solving this problem. These include mud powered turbine drilling devices such as the "turbodrill" produced by Maurer Engineering, Inc., and electric powered drills such as the "electro drill" produced by the Institut Francais Der Petrole. However, these devices have been only marginally successful because of their relatively large size, complexity, difficulty in operation, and in the case of the electric drill, its need for a nearby source of electricity.

The solution of these as well as other problems is the subject of this invention.

BRIEF DESCRIPTION OF THE DRAWINGS

FIG. 5 is similar to FIG. 4 and illustrates apparatus by which the progressive formation of the borehole of this invention is achieved;

FIG. 6 is a reduced, cross sectional view of the earth, having apparatus disclosed therewith by which the borehole of the present invention is formed;

FIG. 7 is an enlarged, broken, side elevational view of part of the apparatus disclosed in FIG. 6;

FIG. 8 is an enlarged, part cross sectional, broken view of part of the apparatus disclosed in FIG. 7; and, FIG. 9 is a detailed view of part of the reaction system previously disclosed in the foregoing figures.

SUMMARY OF THE INVENTION

A vertical borehole is formed from a surface of the earth into proximity of a formation. The lower marginal end or "downhole" portion of the borehole is turned laterally to a desired angle, thereby enabling further penetration to be carried out in a straight line radially from the vertical part of the borehole.

A motor is connected to turn a drill bit, the motor is connected to a straight drill guide means, and the guide means is connected to the end of a flexible pipe. The apparatus forms a tool string which is run downhole on a drill pipe so that drilling can be continued in a straight line at the desired angle which extends laterally away from the vertical part of the borehole, with the lateral part of the borehole being continued through the formation.

In one embodiment of the invention, the motor is a gas turbine. The turbine is powered by compressed fluids such as air, flue gases, and natural gas. The gas turbine is sufficiently small to be moved downhole through a small radius curve. Gas is forced into the turbine at a high temperature and pressure. The gas supply is connected to the drill bit by a planetary gear system so as to bring the rotational speed of the bit to an optimum drilling speed.

Means are provided by which the motor is held against axial rotation which results from the turning reaction of the bit. Means are provided for advancing the motor as the bit cuts into the formation.

A primary object of the present invention is the provision of method and apparatus by which an underground formation can be penetrated by a lateral borehole arranged at any desired radial angle from the vertical.

Another objective of this invention is the provision of a method of forming a borehole which extends vertically downhole into proximity of a formation, turns laterally at a predetermined angle along a small radius of curvature, and then extends in a straight line at the desired angle radially away from the vertical part of the borehole.

Another objective of this invention is the provision of a method and apparatus by which a borehole is curved at any desired angle from the vertical and which can be extended a considerable distance from the lower end of the vertical part of the borehole.

Another objective of this invention is the provision of a method and apparatus for mining isolated ore bodies located a few hundred feet below the surface of the earth by the provision of a borehole which is directed laterally at any desired angle from a vertical part of the borehole, wherein the lateral part of the borehole extends substantially along the entire length of the ore body to be removed.

These and other objects of this invention will become apparent as the same is better understood by reference to the drawings and the following detailed description.

DETAILED DESCRIPTION OF THE PREFERRED EMBODIMENT

Figure 1:
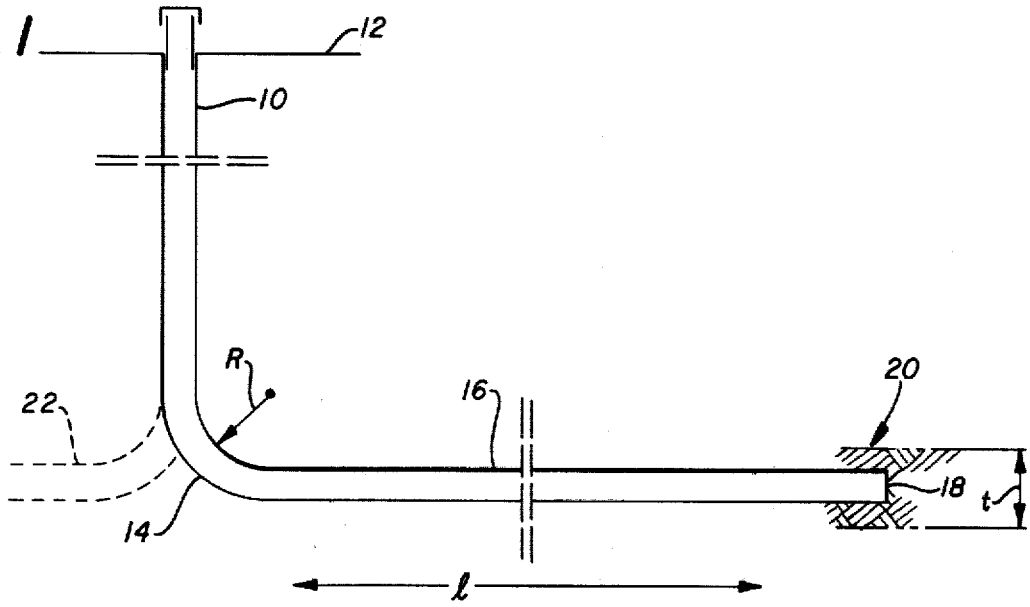
FIG. 1 is a diagrammatical illustration of a cross sectional view of the earth having a borehole formed therein in accordance with the present invention.

In FIG. 1 of the drawings, there is disclosed a borehole 10 which extends vertically downward from the surface 12 of the earth. The borehole continues several hundred feet downhole and then turns laterally away from the vertical, as shown at 14. The borehole continues radially away from the vertical part thereof to form the horizontal part seen at 16. Numeral 18 indicates the lower terminal end of the borehole. The horizontal marginal length of the borehole extends through or into a formation or pay zone 20.

Other laterally directed boreholes 22 can also be radially spaced about the vertical borehole 10, if desired.

The term "pay zone" is intended to denote an ore body such as uranium ore, silver ore, copper, or other metallic ores, as well as hydrocarbons, such as coal. Non-metallic and non-carbonacious material such as flourspar and the like is also considered to be embraced by the term "pay zone".

Figure 2:
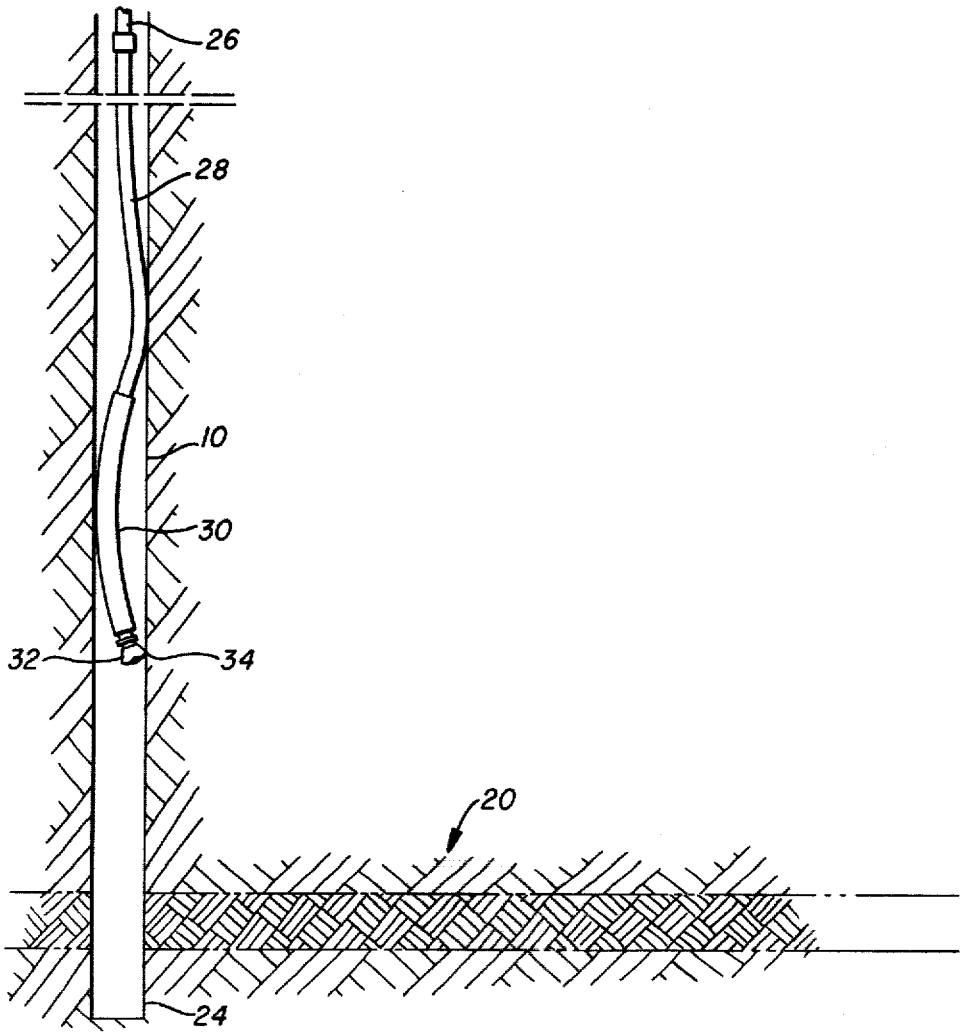
FIGS. 2, 3, and 4 are enlarged, fragmentary, part cross sectional views which disclose a borehole undergoing construction in accordance with the present invention.

In FIG. 2, the upper marginal part of the borehole 10 bottoms at 24 and is formed by the employment of a suitable prior art string of drilling tools. Drill pipe 26 is connected to a drive pipe assembly 28. The lower marginal end of the drive pipe assembly is slidably received through a curved pipe assembly 30. A rock bit 32 is connected to the end of the drive pipe assembly.

Numeral 34 indicates the location along the sidewall of the borehole which must be penetrated by the drill bit in order to intercept formation 20 with the aforementioned laterally directed borehole 16.

Figure 3:
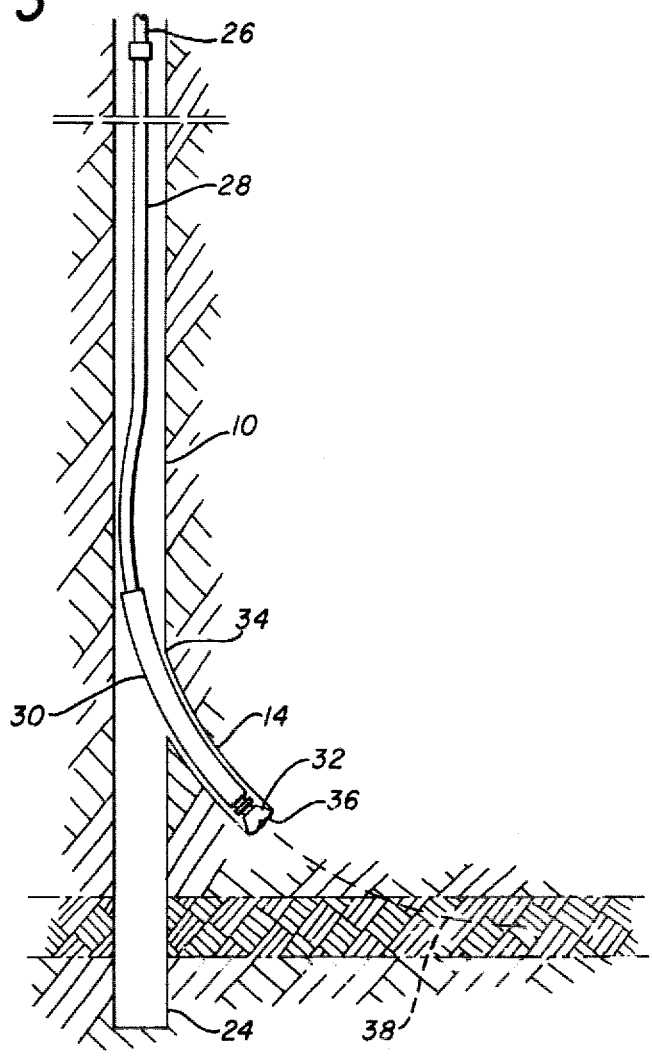

As seen in FIG. 3, the bit has entered the sidewall of the vertical part of the borehole, and is progressing at 14 along a relatively small radius of curvature dictated by the configuration of the curved pipe assembly. Numeral 36 indicates the bottom of the curved part of the borehole which is being engaged by the drill bit. Numeral 38 indicates the intended trajectory of the final curved part of the borehole.

Figure 4:
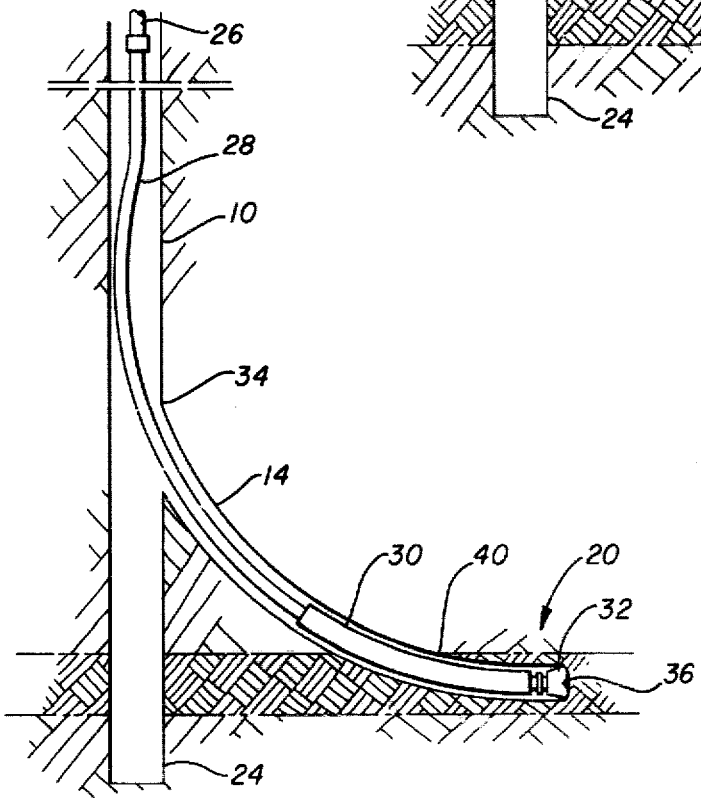

In FIG. 4, numeral 40 indicates the entrance of the curved borehole into the pay zone 20. It will be noted that the curved pipe has followed the bit as the borehole is formed along the radius of the curvature 14, while the flexible drive pipe assembly 28 extends back uphole from the bit, and into attached relationship respective to the drill pipe 26.

In FIG. 5, sub 42 connects a flexible pipe 44 to a conventional string of drill pipe 26. Sub 46 connects a Zublin drill guide 48 to the other end of the flexible pipe. Turbine 50 is connected to the downhole end of the drill guide and includes a shaft 52 connected to rotate drill bit 36.

As seen in FIGS. 5, 7, and 8, exhaust ports 54, which comprise the reaction system, expell spent gas into the borehole. As seen in FIG. 6, the exhausted gases are conducted back up the borehole annulus to the surface of the earth, carrying drilled-up cuttings of the formation from the borehole.

In FIGS. 6–9, the exhaust ports 54 provide for the exhaust gases to resist the turning moment induced by the drill bit 32 into the housing 60. The reactions additionally force the drill bit and motor to be advanced through the formation during the drilling process as is shown in FIG. 9. Directional vanes 56 radiate from exhaust ports 54 to provide the mechanism to direct the exhaust gases in the desired direction. Numeral 62 indicates the intended line of progression made by the bit as it bores through the pay zone.

Numeral 64 indicates ore cuttings admixed with exhaust gases being forced to the surface at 66. Compressed fluid supply 68 is connected through the drill string to the turbine 50.

OPERATION

In operation, the vertical part of the borehole 10 is formed in a conventional manner, with the borehole terminating at 24 as shown in FIG. 2. Next, the Zublin system for forming the curved part of the borehole is assembled in the manner of FIG. 2 and run downhole until the bit is positioned to penetrate the sidewall of the vertical borehole at a predetermined location 34. The location 34 commences the curved portion of the borehole, and the curved part of the borehole is imparted with a radius of curvature suggested by the configuration of the curved pipe assembly 30. The drill bit is attached to the end of the drive pipe assembly 28, as is more particularly shown in FIGS. 6–9. The drive pipe assembly has a lower marginal end rotatably received within the curved pipe assembly so as the drill bit penetrates the formation, the curved pipe assembly is carried therewith, thereby forcing the drilling to proceed along the curved path 14 until formation 20 is horizontally penetrated. Accordingly, the location of penetration 34 must be predetermined and selected by adjustment in the length and design of the tool string, so that the lateral part of the borehole is oriented respective to the pay zone to achieve optimum contact with the ore body.

After formation of the curved part of the borehole 14, the tool string seen in FIG. 2 is removed from the borehole. The borehole now terminates at 36, as seen in FIG. 4, and has been radially directed along a curved path away from the vertical part of the borehole 10, such that formation 20 has been penetrated laterally. In FIGS. 1, 4, and 6, the lateral part of the borehole is orientated horizontally respective to the vertical part 10.

As shown in FIG. 5, after formation of the curved part of the borehole, a flexible pipe 44 is fitted to the end of the conventional drill string 26. A Zublin straight drill guide 48 is attached to the end of the flexible pipe.

A suitable gas driven turbine 50 is connected to the straight drill guide 48, and a rock bit 32 is connected to the downhole end of the tool string by means of a turbine driven planetary gear apparatus.

A fluid reaction system 54 is incorporated in the turbine motor system 54 to provide the necessary forces required for the bit to be forced into cutting engagement with the formation. This reaction also aids in pulling the flexible pipe and the turbine apparatus through the horizontal part of the hole 16. The drill guide 48 maintains the borehole horizontally disposed along a substantially straight course.

I claim:

1. Method of communicating a subterranean formation with the surface of the ground comprising the steps of:

forming a substantially vertical borehole which extends from the surface of the ground, downhole to close proximity of the formation;

penetrating the sidewall of the vertical part of the borehole at a location above the formation equal to the radius of curvature of the part of the borehole to be subsequently turned by positioning a curved pipe downhole in the borehole at the location where the hole is to be turned laterally away from the vertical part of the borehole; said curved pipe having a radius of curvature equal to the desired radius of curvature of the curved part of the borehole;

placing a flexible drive pipe assembly within said curved pipe; and, connecting one end of the drive pipe assembly to a drill pipe string;

attaching a drill bit to a gas turbine and connecting the gas inlet of the turbine to said flexible drive pipe assembly;

providing a resisting action for overcoming the turning reaction of the drill bit as cuttings are removed while penetrating the earth and forming the curved part of the borehole; directing the exhaust gases from said gas turbine away therefrom in a direction to provide at least part of said resisting action;

forcing said bit into engagement with the formation by moving the bit axially in advance of said turbine; and, extending the borehole laterally away from the curved part of the borehole, so that the formation is penetrated substantially horizontally.

2. The method of claim 1 and further including the step of using a flexible hose as part of said flexible drive pipe assembly; and, connecting a source of air to said gas inlet of said turbine.

3. Mining method by which a formation is horizontally penetrated from a vertical borehole which extends downhole substantially to the elevation of the formation and then curves horizontally according to the steps of:

penetrating the sidewall of the vertical part of the borehole at a location above the formation equal to the radius of curvature of the part of the borehole to be turned;

forming the lower end of the borehole into a curve and extending the borehole from the curve, horizontally into the formation;

forming the curved part of the borehole by positioning a curved pipe downhole in the borehole at the location where the borehole is to be turned radially away from the vertical part of the borehole; said curved pipe having a radius of curvature equal to the desired radius of curvature of the curved part of the borehole;

placing a flexible drive pipe assembly within said curved pipe; and, connecting one end of the drive pipe assembly to a drill pipe string;

placing a drill bit on the other end of the flexible drive pipe and rotating the bit while advancing the bit until the curved part of the borehole has been formed;

removing said bit from said flexible drive pipe and attaching a drill bit to a gas turbine and connecting the gas inlet of the turbine to a drill guide means and connecting the drill guide means to the flexible drive pipe;

advancing the bit to form the lateral part of the borehole which extends horizontally into the formation;

arranging the flow of exhaust gases away from said gas turbine so that the gases are directed away therefrom to provide at least part of said resisting action;

forcing said bit into engagement with the formation by moving the bit axially in advance of said turbine.

4. The method of claim 3 and further including the step of using a flexible hose as part of said flexible drive pipe assembly; and, connecting a source of air to said gas inlet of said turbine.

* * * * *